US005295309A

United States Patent [19]

Kozlowski et al.

[11] Patent Number: 5,295,309

[45] Date of Patent: Mar. 22, 1994

[54] JOGGER/AERATOR

[75] Inventors: Brian J. Kozlowski, Stevens Point; Anthony J. Trzebiatowski, Amherst; Perry J. Jewell, Stevens Point, all of Wis.

[73] Assignee: A.F. Machining Specialties, Inc., Plover, Wis.

[21] Appl. No.: 988,239

[22] Filed: Dec. 9, 1992

[51] Int. Cl.[5] ..... F26B 5/00

[52] U.S. Cl. ..... 34/23; 34/54; 34/218; 34/150; 414/766; 414/778; 414/907; 271/146

[58] Field of Search ..... 34/150, 23, 54, 218, 34/219; 271/105, 145, 146, 162; 414/766, 778, 907

[56] References Cited

U.S. PATENT DOCUMENTS

| | | | |
|---|---|---|---|
| 3,089,598 | 5/1963 | Temple . | |
| 3,259,992 | 7/1966 | Bonwit et al. | 271/105 |
| 3,279,092 | 10/1966 | Mariot | 34/150 |
| 3,418,725 | 12/1968 | Ruud | 34/150 |
| 3,656,743 | 4/1972 | Ruud | 271/146 |
| 3,680,220 | 8/1972 | Thompson et al. | 271/105 |
| 3,724,089 | 4/1973 | Thompson et al. | 271/105 |
| 3,764,024 | 10/1973 | Mojden . | |
| 3,791,047 | 2/1974 | Atwood et al. | 34/150 |
| 3,945,095 | 3/1976 | Herold et al. | 34/150 |
| 3,977,670 | 8/1976 | Tsuruta et al. | 271/105 |
| 4,070,767 | 1/1978 | Woodward | 34/38 |
| 4,178,119 | 12/1979 | Busch | 34/150 |
| 4,439,930 | 4/1984 | McMahon, Jr. . | |
| 4,585,225 | 4/1986 | Miura . | |
| 4,665,628 | 5/1987 | Clawson . | |

OTHER PUBLICATIONS

"Parts Book," Model A 73 VA Jogger/Aerator, Automatan Incorporated, Plover, Wis. (no date).

"The Leading Blower," Paxton Centrifugal Blowers, Santa, Monica, Calif. (no date).

*Primary Examiner*—H. Grant Skaggs

*Attorney, Agent, or Firm*—Lathrop & Clark

[57] ABSTRACT

A frame is mounted on driven base rollers for rotatable movement from a horizontal to a vertical position. A platen plate is movable on the frame with respect to a platen plate fixed to the frame to clasp a stack of sheets therebetween. An air table is located behind the platen plates and has a perforated surface, the perforations of which may be selectively obscured. An air blower is driven by a variable speed motor to selectably introduce a flow of air into the air table and through the air table perforations into a stack of sheets clamped by the platen plates. A controller may be remotely positioned from the motor and allows variable control of the air flow quantity through the clamped stack to appropriately aerate a wide variety of sheet materials under varying atmospheric conditions.

13 Claims, 5 Drawing Sheets

JOGGER/AERATOR

FIELD OF THE INVENTION

The present invention relates to sheet handling apparatus in general and to jogger/aerators in particular.

BACKGROUND OF THE INVENTION

In the paper products industry, many paper treating procedures such as printing, folding, die cutting, foil embossing, collating, and binding are performed on sheets of paper fed individually from a palletized stack of sheets. To insure uniform treatment of each sheet, the sheet stock, be it heavy corrugated paperboard, card stock, or lighter weight paper, must be effectively detached from its neighboring sheet before undergoing a processing operation. Adjoining sheets may adhere to one another as the result of static, adhesive properties of ink, or other reasons.

Heavy weight sheet paper material such as corrugated paperboard and card stock have long been aerated by jogger/aerators. Conventionally, these machines receive a stack of paper loaded vertically upon a pallet, rotate the stack 90°, and disperse a flow of air through a restricted segment of the stack to separate the sheets while vibrating and aligning them.

Conventional jogger/aerators are provided with one or two blowers, the output of which may be combined to direct a first or a second level intensity of air flow through the stacked sheets. Some prior art jogger/aerators are also provided with an air escape valve which allows a portion of the blower output to be directed away from the paper stack. Although adequate for corrugated paperboard and other relatively stiff paper stock, conventional jogger/aerators have proved inadequate in handling light-weight stock comprised of sheets having substantially no vertical stiffness. Light-weight stock when subjected to the intense incremental air blast of a conventional jogger/aerator may well be blown clear of the machine causing the loss of a significant portion of the stack. Heretofore, light-weight paper sheets have typically been aerated by hand manipulation of small stacks of paper.

What is needed is a jogger/aerator which may handle light weight stocks and which is controllable to prevent damage to the stack.

SUMMARY OF THE INVENTION

The jogger/aerator of the present invention has a frame which is rotatable on arcuate tracks which engage with driven rollers on a fixed base. A first platen plate is mounted to the frame and a movable platen plate is spaced from the first platen plate and movable in substantially parallel relation away from and toward the first platen to adjustably clasp a stack of sheets between the platen plates. An air table is located behind the platen plates and has several strips of perforations which allow air to escape from the table and which direct the flow of air substantially perpendicular to the front surface of the table. One or two air blowers are connected to direct a flow of air into the air table. A variable speed motor is connected to each blower to allow variable control of the quantity of air directed into the air table. A remote controller is connected to the variable speed motor and allows the speed of the motor to be manipulated by a user to adjustably vary the volume of air flow through the air table and thence through the sheet stack to appropriately aerate the stack. Precise control of the air flow and platen position by an operator adjacent to the stack is thus made possible by the jogger/aerator of the present invention. This precise control enables aerating of a wide variety of sheet materials under a variety of atmospheric conditions. In particular, light weight sheet stock may be handled by this jogger/aerator. The jogger/aerator of this invention although sharing many parts of prior art apparatus performs in a dramatically different manner, utilizing precise quantities of air to support flexible sheets in a vertical orientation.

It is an object of the present invention to provide a jogger/aerator which effectively aerates light-weight paper sheets.

It is a further object of the present invention to provide a jogger/aerator which may accomodate a wide range of paper stocks under a variety of atmospheric conditions.

It is another object of the present invention to provide a jogger/aerator which is adjustable by an operator to accurately manipulate the sheets within the stack.

Further objects, features and advantages of the invention will become apparent from the following description when taken in conjunction with the accompanying drawing.

DESCRIPTION OF THE PREFERRED EMBODIMENT

Figure 1:
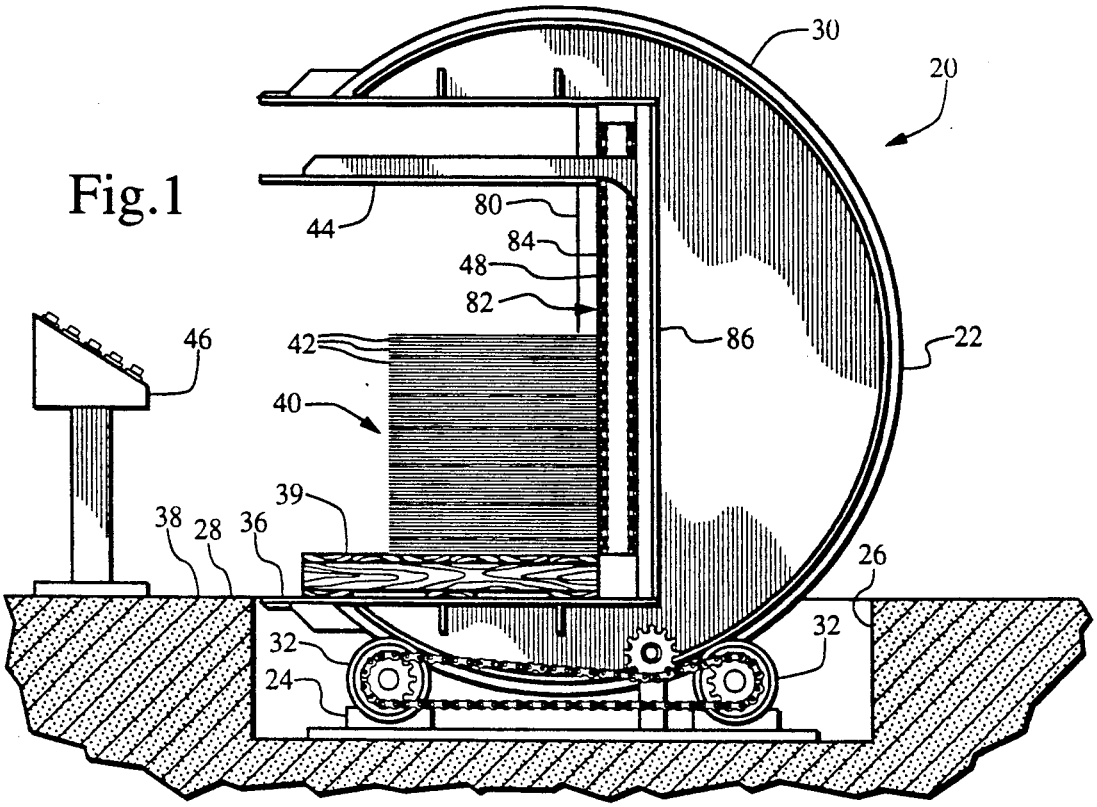
FIG. 1 is a side elevational view of the jogger/aerator of the present invention with the frame disclosed in a vertical position.

Referring more particularly to FIGS. 1–8, wherein like numbers refer to similar parts, the jogger/aerator 20 of the present invention is shown in FIG. 1. Prior art jogger/aerators have been utilized with corrugated cardboard and other heavy, relatively stiff paper stocks. The jogger/aerator of the present invention uses air in an intensely operator controlled manner to permit the jogging and aerating of light weight papers of less than 100 lb weight. Prior art jogger/aerators relied on the stiffness of the sheets to remain upright. The present invention utilizes controlled air flow.

The jogger/aerator 20 has a frame 22 which is mounted for rotatable movement on a base 24 which is fixed within a pit 26 formed in the foundation 28 of a structure. The frame 22 has two parallel generally circular tracks 30. Each track 30 engages with two pairs of rollers 32 which are mounted to the base 24 and which are driven by a motor 34.

The frame 22 has a fixed platen 36 which is positioned to be in the same plane as the upper surface 38 of the foundation 28 when the frame is in the vertical position shown in FIG. 1. The fixed platen 36 is adapted to receive a stack 40 of adjacent horizontal sheets 42 of paper, paperboard, corrugated cardboard, synthetic material, or other sheet adapted for printing or related operation, collectively referred to herein as sheets. A movable platen 44 is mounted to the frame 22 in spaced parallel relation to the fixed platen 36. The movable platen 44 is driven by single or plural chain drives (not shown) to clamp the stack 40 between the movable platen 44 and the fixed platen 36. The position of the movable platen 44, and hence the degree of restraint on the stack 40, is controllable by an operator from a remote mobile controller 46, shown in FIGS. 1-3. The controller 46 provides controls for manipulating the position of the jogger/aerator machine elements at a location remote from the jogger/aerator as well as by an operator positioned directly on the jogger/aerator.

Figure 4:
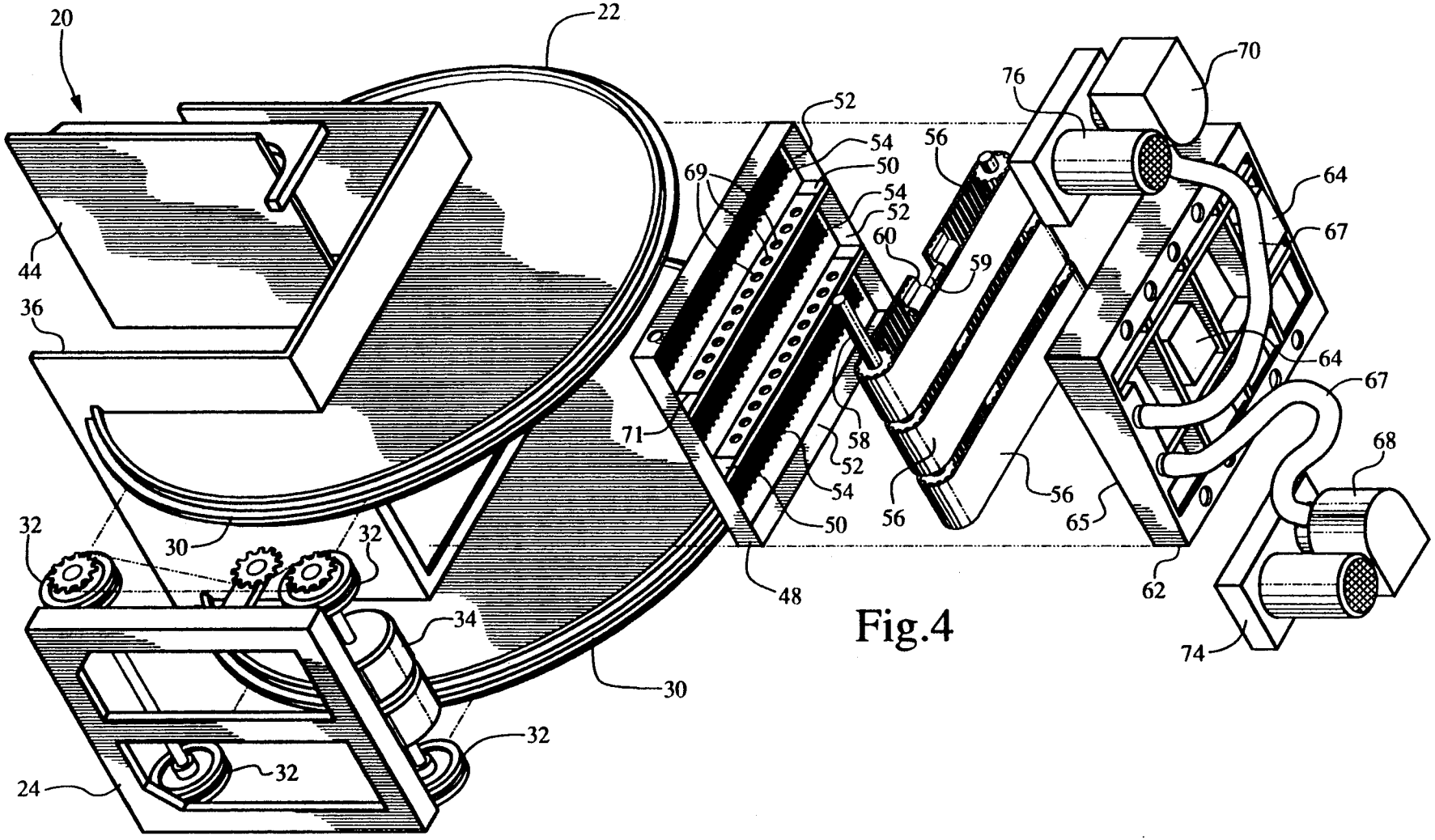
FIG. 4 is an exploded isometric view of the jogger/aerator of FIG. 1.

As best shown in FIG. 4, a rigid air table 48 is mounted to the frame 22 rearward of the platens 36, 44. The air table 48 is divided by two barriers 50 into three chambers 52. Each chamber 52 has a strip 54 defining a region of regularly spaced perforations which run the length of the air table 48. A timing belt 56 is mounted within each chamber 52 so as to obscure a portion of the perforation strip 54 within that chamber. The three timing belts 56 are co-rotatably mounted to a timing belt shaft 58 which is driven by an electric motor. Each timing belt 56 is formed into a loop by a belt connector 59 which spaces the belt ends from one another to define a gap 60. It is only through the gaps 60 that air introduced into the air table 48 may escape through the perforation strips 54. Driving of the timing belts 56 thus results in the displacement of the timing belt gaps 60 along the length of the air table 48 and a consequent movement of a region of air flow. The air table 48 is connected to a vibrating deck 62 at the rear of the frame 22. The vibrating deck 62 is preferably provided with a plurality of vibrators 64 which are selectively driven by electric motors to vibrate the deck 62 and the connected air table 48 to facilitate jogging of the sheets 42. The intensity and frequency of vibrations is also adjustable from the controller 46. The vibrating deck 62 is provided with an air plenum 65 which directs air from one or two blowers 68, 70 into two of the three chambers 52. The air table barriers 50 are provided with slidable valve plates 71 which are movable to allow passage of air between adjacent chambers through holes 69 formed in the barriers 50.

Although the jogger/aerator 20 may have only a single blower, in a preferred embodiment both a small blower 68, and a large blower 70 are connected to the plenum 65 to direct a flow of air through ducts 67 into the air table 48. Each blower 68, 70 is driven by an associated variable speed electric motor 74, 76. In a preferred embodiment, the blowers 68, 70 are RM-87C blowers manufactured by Paxton products, Inc. of Santa Monica, Calif. The small blower 68 may be provided with a 7.5 horsepower motor 74 and is preferably capable of producing pressures of 68 inches of water and flow rates of 575 cubic feet per minute. The large blower 70 may be provided with a 10 horsepower motor 76 capable of producing pressures of 92 inches of mercury at a flow rate of 325 cubic feet per minute. The motors 74, 76 are both variable speed motors controlled by a potentiometer 78 located on the controller 46. The blowers with variable speed motors provide a means for producing a flow of air through the air table perforations which is adjustable by the operator to produce any desired air flow between zero and an upper limit set by the power of the drive motor.

Figure 2:
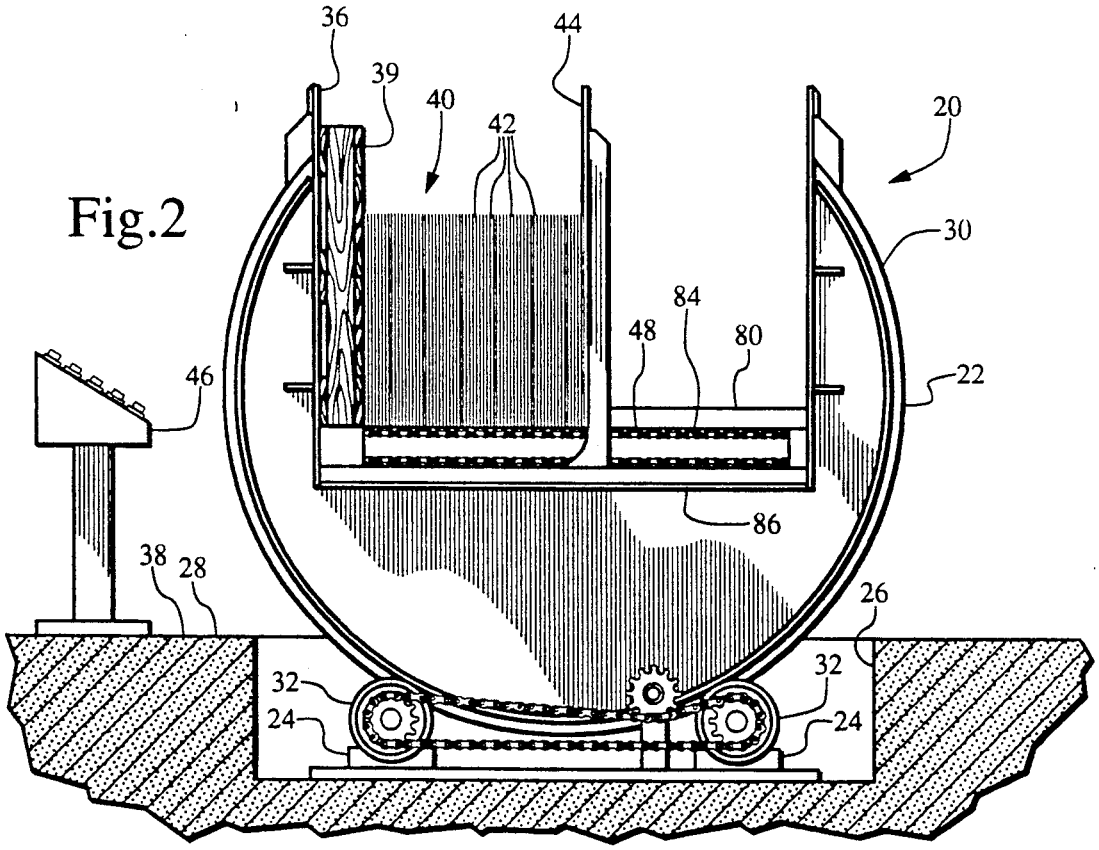
FIG. 2 is a side elevational view of the jogger/aerator of FIG. 1 in a horizontal position.
Figure 3:
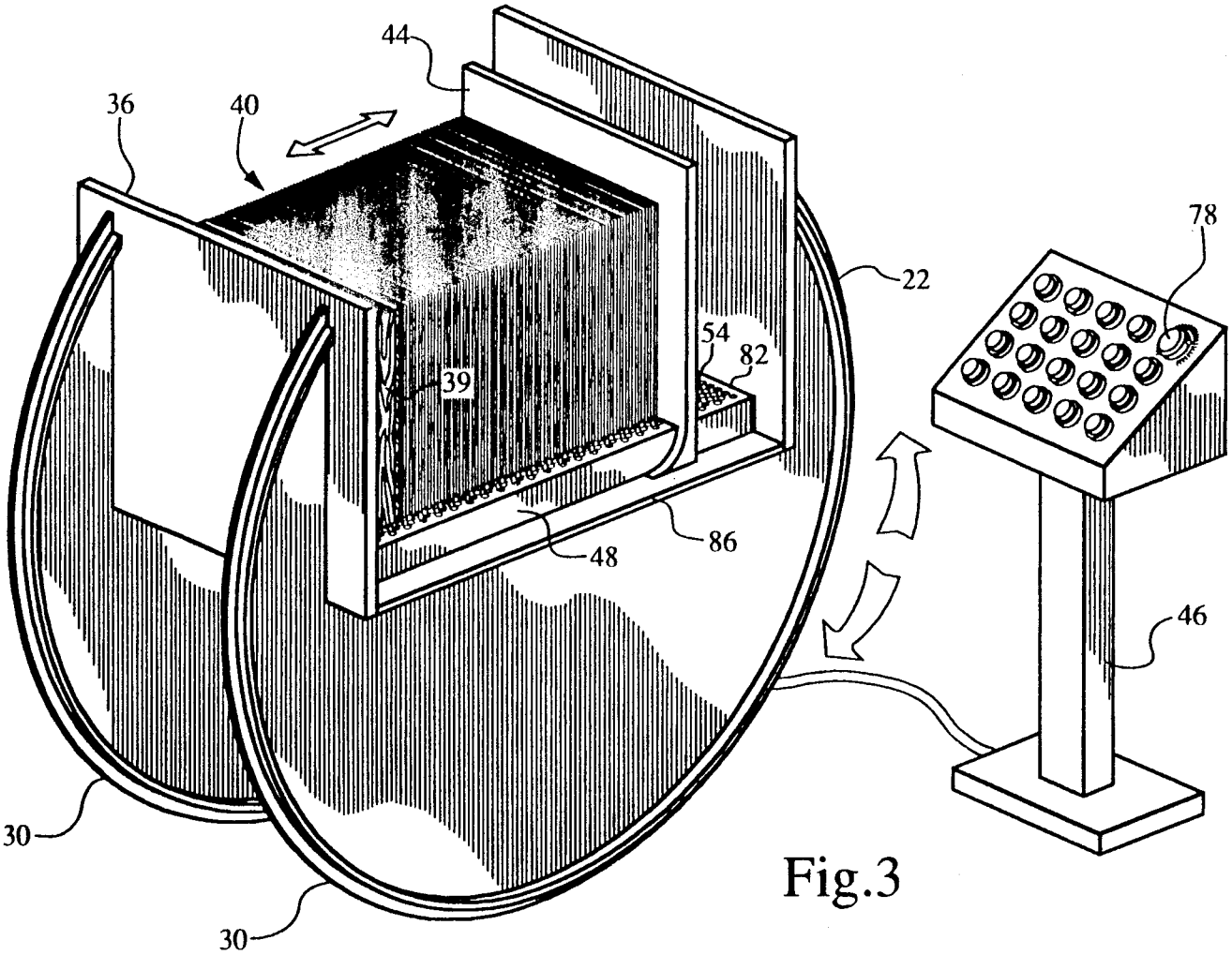
FIG. 3 is a fragmentary isometric view of the jogger/aerator of FIG. 2 with frame and platen motion shown schematically by arrows.

As shown in FIGS. 1 and 2, a stack 40 of sheets 42 to be jogged and aerated is loaded onto the jogger/aerator 20 in the conventional way. The stack 40 is positioned on the fixed platen 36 so that one side of the stack 40 is adjacent the jogging edge 80 such that the rear of the stack 42 is adjacent the surface 82 of the air table 48. Once the stack 40 has been properly positioned either manually or by a forklift vehicle, the operator causes the movable platen 44 to advance towards the fixed platen 36 to grip the stack 40 therebetween. Once the stack 40 has been clamped between the platens 36, 44, the operator causes the frame 22 to rotate on the base 24 to bring the sheets of the stack 40 into a vertical position as shown in FIG. 2.

Vertically oriented sheets, especially light-weight sheets such as those of 50-60 pound stock, have very little vertical stiffness. The sheets are maintained in their upright position initially by the clamping force of the platens 36, 44. In order to properly aerate the stack 40 it is necessary to relieve the sidewards pressure of the platens while maintaining the vertical orientation of the individual sheets 42. Prior art jogger/aerators employed blowers of fixed output. Air flow to the stack could be controlled by selecting one or several blowers or by venting a fixed fraction of the air flow away from the stack. Although this crude control of air flow may be acceptable in aerating stiff sheets such as corrugated cardboard sheets, the prior art devices were not able to aerate lighter weight sheets. Experimentation has shown that no preset level of air flow will always be appropriate for a given paper stock, due to the wide range of variables that affect the proper air flow level.

To aerate a stack 40 in the jogger/aerator 20 of the present invention, the operator activates the vibrators 64 and gradually moves apart the platens, 36, 44 while adjusting the potentiometer 78 to admit greater amounts of air through the perforation strips 54.

In the preferred embodiment a drive chain 84, shown in FIGS. 1 and 2, is employed to drive the timing belt shaft 58 and is visible to an operator alongside the air table 48. The belt drive chain 84 is advantageously marked to indicate to an operator the location of the belt gap 60 with respect to the air table surface 82. To fully aerate a stack 40, the belt gap 60 must traverse the length of the air table 48 between the platens 36, 44.

To effectively aerate a stack 40, the operator positions himself on a ledge 86 which projects from the frame 22 beneath the air table 48. The mobile controller 46 may be moved alongside the ledge 86 so that the operator has access both to the stack and to the jogger/aerator controls. With one blower activated, the operator continues to increase the speed of the drive motor 74 to increase the volume of air flow through the belt gap 60 and into the stack 40. The operator may judge when an appropriate aeration is taking place by a visual inspection of the stack 40 as well as by placing his hands on the aerated portion to determine whether proper free motion of sheets has been obtained.

Figure 6:
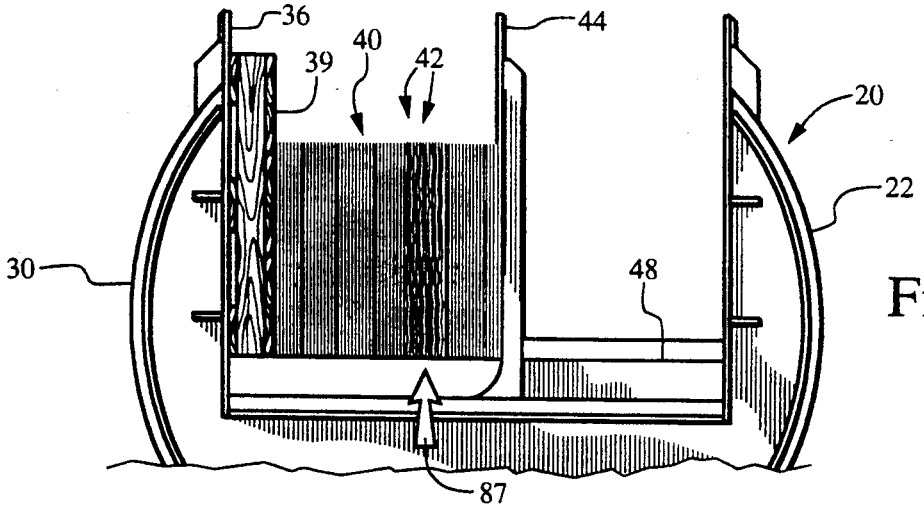
FIG. 6 is a fragmentary side elevational view of the jogger/aerator of FIG. 2 illustrating the effect of an appropriate amount of air flow through a paper stack.

Proper aeration for a particular stack 40, as shown in FIG. 6, is achieved only over a very narrow range of air flow. Many variables affect the performance of sheets 42 within a stack 40 when subjected to an air flow through the air table 48. The weight of the sheet, the length and width of the sheet, the ambient humidity and temperature, local moisture content of the sheets, whether the sheets have been printed on or die cut, whether the sheets have been previously aerated, atmospheric pressure, dust content, and other factors will all influence the quantity of air required to obtain an acceptable controlled aeration. Although a prior art jogger/aerator could not handle paper stocks of 100 lbs or less, the present invention will be employed with sheets as low as approximately 50 lbs.

Figure 5:
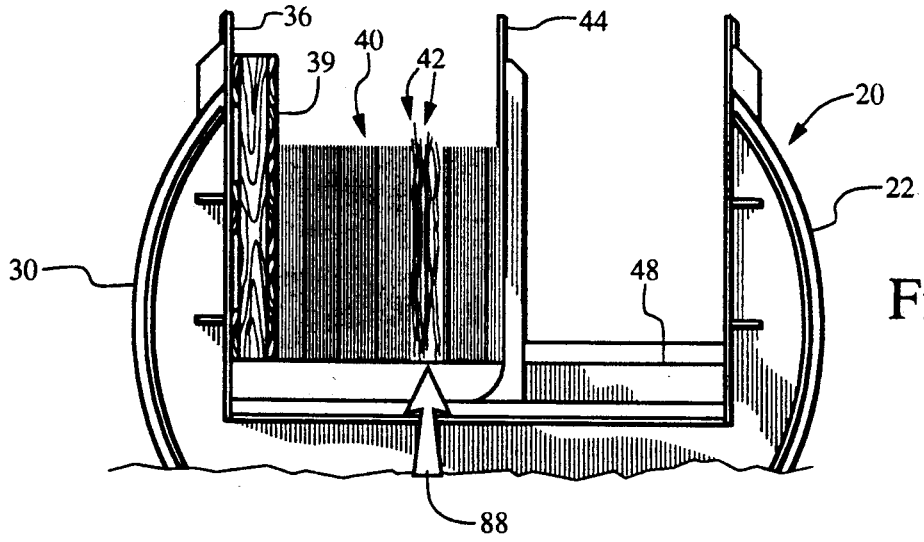
FIG. 5 is a fragmentary side elevational view of the jogger/aerator of FIG. 2 illustrating the effects of excessive air flow through a paper stack.
Figure 7:
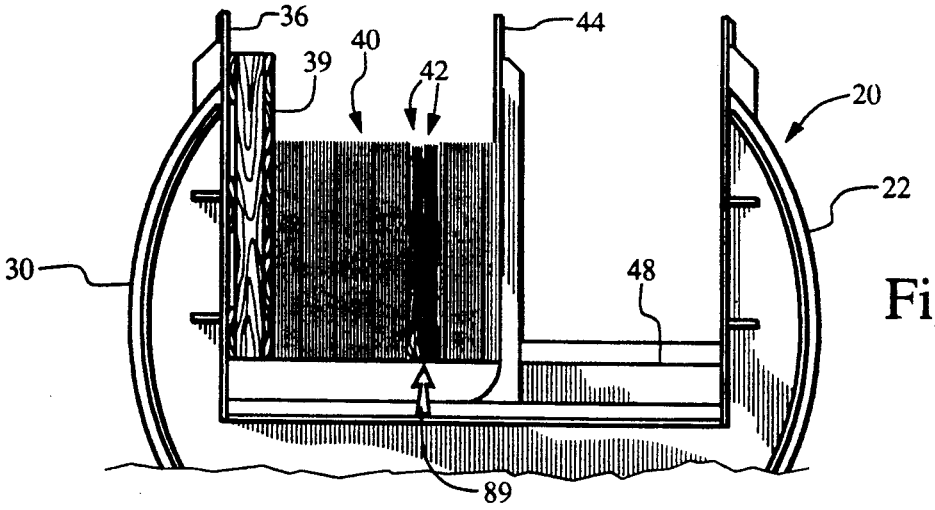
FIG. 7 is a fragmentary side elevational view of the jogger/aerator of FIG. 1 illustrating an insufficient air flow through a stack.
Figure 8:
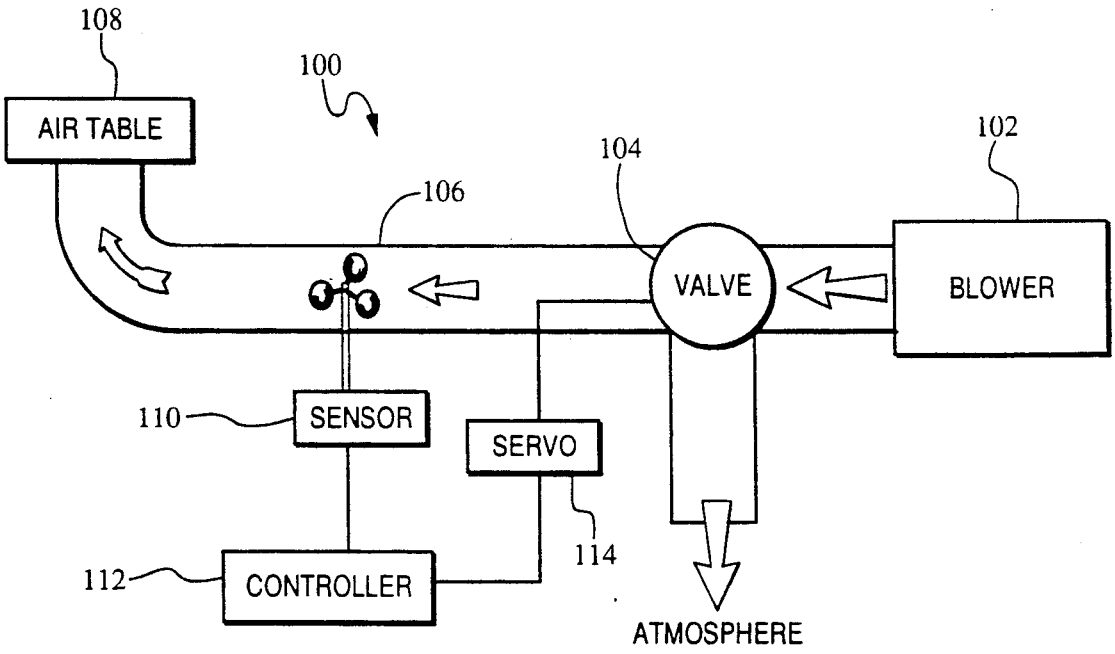
FIG. 8 is a schematic view of the variable air flow supply apparatus of an alternative jogger/aerator of the present invention.

The undesirable consequences of excessive or inadequate air flow through the stack 40 are illustrated in FIGS. 5 and 7. The result of a correct air flow is illustrated in FIG. 6. The adequate air flow is indicated schematically by the arrow 87. When properly aerated, individual sheets 42 are separated from one another yet remain supported vertically in ordered array within the stack 40. When a segment of a stack 40 is in this condition, individual sheets 42 may be removed from and restored to the stack 40 without damage to the sheet or adjacent sheets within the stack. However, as shown in FIG. 5, an excessive quantity of air, indicated by the arrow 88, will cause individual sheets 42 to be blown away from the air table surface 82, possibly ejecting the quantity of sheets from the jogger/aerator 20 entirely. This blowing free of sheets will not only damage the ejected sheets but will very likely injure adjacent sheets within the stack which will collapse to fill the space vacated by the blown sheets.

Although excessive air flow is to be avoided, inadequate air flow can also be destructive to the stack 40 as shown in FIG. 7. An inadequate flow of air, indicated by arrow 89, will be insufficient to support the sheets 42 in a vertical position. Because the platens 36, 44 do not support the sheets during aeration, the sheets over the belt gap 60 will collapse with a turning inward of the bottom edges of the sheets. The resulting crimped or wrinkled sheets are hence rendered unusable. The variability of sheet characteristics and atmospheric conditions are advantageously addressed in the jogger/aerator 20 of the present invention by providing blowers 68, 70 with motors 74, 76 which are variable from substantially no air flow to the maximum output allowing the flow to be fixed at any level in between.

In applications requiring larger air flows, the 10 horse power motor 76 may be activated initially, with the smaller motor 74 and blower 68 brought on as additional air flow is required.

Although in a preferred embodiment A.C. motors are employed, variable speed D.C. motors may also be employed. Also, a mechanical adjustable transmission connected to a motor of a constant rotational speed is encompassed within the meaning of variable speed motor for the purposes of this application.

The mobile controller is positionable by the operator alongside the jogger/aerator ledge 86 to be readily accessible by the operator as he moves along the width of the stack.

It is important to note that the jogger/aerator 20 when employed with light weight papers functions in a manner which is dramatically different from prior art machines. In employing the prior art jogger/aerator an operator had control of platen spacing and air gap belt travel. The quantity of air flow was set for a particular size or weight of sheet stock, and was not controllably adjustable during the process of aeration. A stack of light weight paper stock, if placed in a prior art jogger/aerator, would have been blown out of the platens or have collapsed. It has been found after experimentation with a jogger/aerator constructed according to the present invention, that by judiciously releasing the platens and increasing the air flow through the paper stack, paper stocks may be aerated in the present apparatus which were heretofore only manipulatable by tedious hand methods.

It should further be noted that variables in paper stiffness, atmospheric conditions, and air flow are so numerous that some experience is required for an operator to achieve proficiency in operation. The lightest weight paper stocks are so sensitive to air blast, that it may be necessary for the operator to be in physical contact with the stack, adjusting and positioning the sheets, while at the same time adjusting the air flow and the platen spacing.

It should be noted that the air table through which air flow is directed to the paper stack may be in the form of a movable perforated duct outlet which may be traversed across the paper stack. Such an air shoe may also have vibrators mounted thereon.

It should also be noted that in place of one fixed and one movable platen, two movable platens may be employed.

An alternative apparatus for supplying a controllable and variable air flow to the air table may be provided utilizing a source of air flow which need not be variable. The alternative apparatus 100 is illustrated schematically in FIG. 8.

The jogger/aerator 100 has a base, frame, and platens similar to those of the jogger/aerator 20. However, the blower 102 is a constant output blower. A valve 104, such as a three-way ball valve, is placed in the duct 106 which extends from the blower 102 to the air table 108. The valve 104 is adjustable to admit a greater or lesser amount of the blower 102 output into the air table 108. That portion of the blower output which is not ducted to the air table is discharged to the atmosphere. To achieve the degree of fine control over the air flow through the air table 108 required to aerate lighter weight sheets, the valve must be provided with a means for detecting the air flow as a result of a change in the valve position, and a means for adjusting the valve in an active manner to maintain the desired air flow. Due to the nonlinearity of valve performance and compressible fluid attributes within the system, the apparatus 100 must include a control circuit which makes possible the precise setting of the air flow by an operator who merely positions a single control switch such as a potentiometer at a desired setting. A sensor 110 is located within the duct 106 to detect the characteristics of the air flow within the duct. Among the flow attributes which may be detected are pressure, volumetric flow rate and velocity. The sensor may be of various simple or compound designs, such as a pressure transducer, a hot wire or mechanical anemometer, a pitot tube, or an integrating energy sensor. The sensor 110 detects attributes of the air flow within the duct 106 and transmits this data to a controller 112 which is preferably a microprocessor. The controller has a control law incorporated therein which allows the linear adjustment by an operator of a control such as a potentiometer to result in the linear adjustment of the air flow to the air table. The control law will depend upon the fluid dynamics of the system and the characteristics of the particular valve employed.

The controller 112 in turn controls a servo 114 which drives the valve 104 to control the proportion of the blower output which enters the air table. The servo may utilize hydraulic or pneumatic drive means, or may employ stepper motors. The valve 104 may have position feed back or may be controlled open loop.

In operation a command by the jogger/aerator operator for an increase of air flow by an incremental amount will result in the controller 112 servoing the valve 104 as determined by the control law to achieve an increased air flow. The sensor 110 and controller 112 will constantly detect and determine whether the valve should be opened further or closed off to achieve the desired flow characteristics.

It should be noted that placement of the sensor 110 will depend on the type of sensor employed, the control law, and the characteristics of the duct and valve system. The controlled valve apparatus just described may alternatively be employed with a movable air table in the form of one or more positionable air shoes.

It is understood that the invention is not confined to the particular construction and arrangement of parts herein illustrated and described, but embraces such modified forms thereof as come within the scope of the following claims.

We claim:

1. An apparatus for jogging and aerating a stack of sheets, comprising:

a) a fixed base;

b) a frame mounted for rotatable motion on the base;

c) a first platen plate mounted to the frame;

d) a movable platen plate spaced from the first platen plate and movable in substantially parallel relation away from and toward the first platen, wherein the first platen and the movable platen are adapted to clasp a stack of sheets therebetween;

e) an air table mounted to the frame and having a planar front surface, wherein the table has portions defining a plurality of openings therein for directing a flow of air substantially perpendicular to the front surface and into the stack of sheets between the platen plates;

f) an air blower connected to direct a flow of air into the air table;

g) a variable speed motor connected to the blower so as to variably control the flow of air directed into the air table; and h) a controller connected to the variable speed motor and adapted to be manipulated by a user to adjustably vary the volume of air flow through the table and thence through the sheet stack to aerate the stack.

2. The apparatus of claim 1 wherein the controller is movable so as to be positionable for access by a user positioned on the apparatus frame or spaced from the apparatus.

3. The apparatus of claim 1 further comprising a second air blower and second variable speed motor attached to the apparatus and adapted to direct a flow of air into the air table.

4. The apparatus of claim 1 further comprising a means for vibrating the air table to assist in jogging the stack.

5. An apparatus for aerating a stack of sheets, comprising:

a) a base;

b) a frame mounted to the base for rotatable movement between a vertical and a horizontal position;

c) a first platen plate fixed to the frame;

d) a second platen plate mounted to the frame and variably positionable on the frame in substantially parallel relation to the first platen plate to clamp a stack of sheets therebetween;

e) an air table having a surface having portions defining a plurality of openings therein, the openings being directed toward the stack of sheets;

f) a means for producing a flow of air through the air table surface, wherein the means is adjustable by an operator to selectably produce a desired flow of air, the means being adapted to produce any desired quantity of air flow between zero and an upper limit of air flow, such variable air flow allowing the aeration of a variety of sheet materials on the apparatus.

6. The apparatus of claim 5 further comprising a means for vibrating the air table to assist in jogging the stack.

7. The apparatus of claim 5 wherein the means for producing a flow of air comprises a blower driven by a variable speed motor.

8. The apparatus of claim 5 further comprising a controller positionable with respect to the apparatus for access by an operator, and adapted to control the quantity of air flow through the air table openings.

9. The apparatus of claim 5 wherein the means for producing a flow of air through the air table surface comprises:

a) a source of air flow;

b) a valve which is controllable to direct air from the source to the air table or to vent said air from the apparatus;

c) a sensor positioned in the flow of air from the air source to detect air flow attributes; and d) a controller adapted to receive data from the sensor and adapted to control the valve in response to the air flow attributes to control air flow into the air table at a desired level.

10. The apparatus of claim 9 further comprising at least one vibrator connected to vibrate the table.

11. An apparatus for aerating a stack of sheets, comprising:

a) a base;

b) a frame rotatably mounted to the base;

c) a table mounted to the frame, wherein the table is adapted to engage the edges of a plurality of sheets in a stack;

d) two platens mounted to the frame, wherein the distance between the platens is adjustable to clasp the stack of sheets engaged by the table therebetween;

e) portions of the table defining a plurality of openings;

f) a blower adapted to direct a flow of air through the table openings and between adjacent sheets within a stack;

g) a variable speed motor connected to the blower to drive the motor to produce a variable flow of air through the air deck opening; and h) a controller adapted to control the speed of the motor and the position of the platens, wherein the controller is movable and positionable for use by an operator to control the flow of air through and the clasping of a sheet stack to achieve aeration thereof.

12. A method for aerating a stack of paper sheets positioned on a surface having a plurality of holes for the admission of air into the stack, wherein the sheets extend vertically from the surface between two adjustably spaced platens, the method comprising the steps of:

a) spacing the platens a distance from one another greater than the combined thickness of the sheets;

b) increasing the flow of air through the holes in the surface while increasing the spacing between the platens until at least a portion of the sheets are supported in a substantially vertical orientation by the air flow.

13. An apparatus for jogging and aerating a stack of sheets, comprising:

a) a fixed base;

b) a frame mounted for rotatable motion on the base;

c) a first platen plate mounted to the frame;

d) a movable platen plate spaced from the first platen plate and movable in substantially parallel relation away from and toward the first platen, wherein the first platen and the movable platen are adapted to clasp a stack of sheets therebetween;

e) an air table mounted to the frame which underlies a stack of sheets clasped between the movable platen plate and the first platen plate, wherein the air table has a planar front surface, and wherein the table has portions defining a plurality of openings therein for directing a flow of air substantially perpendicular to the front surface;

f) an air blower connected to direct a flow of air into the air table;

g) a valve connected between the blower and the air table, wherein the valve is controllable to direct a portion of the air flow to the air table and the remaining portion away from the air table;

h) a sensor positioned in the flow of air to detect air flow attributes; and i) a controller adapted to receive air flow attribute data from the sensor and adapted to control the valve in response to air flow attributes to control air flow at a desired level, and wherein the controller may be manipulated by an operator to adjust the air flow level.

* * * * *